US012516905B2

(12) United States Patent
Moritz et al.

(10) Patent No.: US 12,516,905 B2
(45) Date of Patent: Jan. 6, 2026

(54) PNEUMATIC LAUNCHER BARREL HOUSING SYSTEM

(71) Applicants: Colin Moritz, Austin, TX (US); Brady Moritz, Houston, TX (US)

(72) Inventors: Colin Moritz, Austin, TX (US); Brady Moritz, Houston, TX (US)

( * ) Notice: Subject to any disclaimer, the term of this patent is extended or adjusted under 35 U.S.C. 154(b) by 16 days.

(21) Appl. No.: 18/530,141

(22) Filed: Dec. 5, 2023

(65) Prior Publication Data

US 2024/0183635 A1 Jun. 6, 2024

Related U.S. Application Data

(60) Provisional application No. 63/386,055, filed on Dec. 5, 2022.

(51) Int. Cl.
*F41B 11/70* (2013.01)

(52) U.S. Cl.
CPC ..... *F41B 11/70* (2013.01)

(58) Field of Classification Search
CPC ..... F41B 11/00; F41B 11/70; F41A 21/32; F41A 21/325; F41A 21/34; F41A 21/36; F41A 21/40; F41A 21/30; F41A 21/28
See application file for complete search history.

(56) References Cited

U.S. PATENT DOCUMENTS

| | | | | |
|---|---|---|---|---|
| 8,776,771 | B1 * | 7/2014 | Yang | F42B 12/40 124/71 |
| 11,703,303 | B1 * | 7/2023 | Bray | F41A 21/36 124/83 |
| 11,885,585 | B2 * | 1/2024 | Caudle | F41B 11/70 |
| 11,898,817 | B1 * | 2/2024 | Bray | F41A 21/30 |
| 2004/0173403 | A1 * | 9/2004 | Shafer | F41B 11/00 181/223 |
| 2005/0066954 | A1 * | 3/2005 | Williams | F42B 10/26 124/83 |
| 2014/0238373 | A1 * | 8/2014 | Yang | F41B 11/70 124/83 |
| 2017/0336165 | A1 * | 11/2017 | Wirth | F41A 21/30 |
| 2022/0268549 | A1 * | 8/2022 | Caudle | F41B 11/70 |
| 2022/0399001 | A1 * | 12/2022 | McCaslin | F41B 11/70 |

* cited by examiner

*Primary Examiner* — Benjamin P Lee
(74) *Attorney, Agent, or Firm* — Kearney, McWilliams & Davis, PLLC; William Yarbrough

(57) ABSTRACT

The present invention is a system and method pertaining to a Pneumatic Launcher Barrel Housing designed for enhanced noise suppression during projectile launching, maintaining shot accuracy and consistency, and allowing for greater customization and configurability. The system comprises an external layer, removable and replaceable internal layer(s), and air gap(s) between layers. The external layer facilitates attachment to existing projectile guns and provides a framework for securing internal layer(s), creating an air gap. The internal layer guides the paintball, utilizing expanding gases from the projectile gun to accelerate it through a stabilized path. This aids in dissipating residual air pressure and ensuring consistent shot trajectories.

20 Claims, 3 Drawing Sheets

PNEUMATIC LAUNCHER BARREL HOUSING SYSTEM

REFERENCE TO RELATED PATENTS

The present application claims priority to the previously filed U.S. provisional application No. 63/386,0550 filed Dec. 5, 2022.

CROSS-REFERENCE TO RELATED APPLICATIONS

U.S. Provisional Patent No. 63/386,055 filed Dec. 5, 2022

FEDERALLY SPONSORED RESEARCH OR DEVELOPMENT

Not Applicable

INCORPORATION BY REFERENCE OF MATERIAL SUBMITTED ON A COMPACT DISK

Not Applicable

FIELD OF THE INVENTION

The present invention relates generally to an apparatus, system and method of use comprising a combination of individual components for a Pneumatic Launcher Barrel Housing System for accelerating and guiding a projectile from a pneumatic launcher in such a way that minimizes noise and aids in the accuracy of an accelerated projectile by facilitating said projectile's straight flight path. Moreover, the present invention that is the Pneumatic Launcher Barrel Housing System applies specifically to an apparatus for housing and arranging components of a pneumatic launcher barrel wherein there exists an outer structural (sleeve/barrel) layer, with the purpose of mounting to a pneumatic projectile launcher, as well as an internal sleeve (barrel) layer made up of one or more concentric, internal sleeves, exhibited coaxially, corresponding to the centerline of the outer cylindrical layer and between said outer barrel layer and said centerline wherein an internal sleeve exist in sealed communication with an outer sleeve for movement of compressed gas from behind a projectile to in front of a projectile as to allow for compressed gas regulation, shunting and dissipation. The outer cylindrical layer provides a means of securing the internal layers in concentric alignment while the inner layer performs the function of air regulation as it relates to said projectile in order to traverse the length of concentric barrel layers.

DESCRIPTION OF RELATED ART

In the field of paintball, as well as with other pneumatic projectile launchers and varied uses, typical equipment consists of a launcher, a compressed gas source, a hopper or clip for storing projectiles, and a barrel for guiding a projectile or succession of projectiles, ideally keeping the projectile(s) stable as the projectile(s) is/are accelerated through the barrel prior to launch. The barrel itself may also serve a secondary function to limit the audio level from gasses escaping rapidly from behind the projectile as the projectile moves along the length of the inner barrel layer, staring at the projectile launcher's projectile receiver, and first end, proceeding along the interior of the inner layer and exiting the barrel's muzzle, at a second end, wherein the inner sleeve and outer sleeve run in parallel, coaxially, from the projectile receiver, along the length of each barrel layer and terminating together conterminously at the muzzle. However, inventors also contemplate a system whereby the inner sleeve and outer sleeve are offset wherein said inner sleeve terminates at a distance before the termination of the outer sleeve, coterminous with the outer sleeve or before said outer sleeve as design and operability dictate.

Many projectile launchers, specifically in the field of paintball, allow for removable and replaceable barrels from the launcher. Previous designs of these barrels have been single layer tube designs, or if having two layers, such barrels exhibit no or no substantial "air gap" between the inner and outer layers. The present invention improves on the previous designs by allowing for removal and replacement of an internal (inner) sleeve as opposed to only a primary internal sleeve or an inner and outer sleeve in such close communication as to practically be a single sleeve. Further, the present invention also improves on the previous designs by providing a substantial "air gap" or space between the external (outer) tubular layer or barrel and one or more of the internal layers. The substantial air gap space provides a controlled pneumatic reservoir between outer and inner layer(s) for the porting of a compressed gas (e.g., high-pressure air (HPA), nitrogen or carbon dioxide) which assists in absorbing, shunting, redirecting and venting excess gas pressure from behind the projectile (directing gas to an area in front of the projectile) prior to the projectile exiting the barrel thus allowing for gas movement along a high-to-low pressure gradient and through the existing exit at the second end (distal from the user). This aids in a more stable flight path of projectile(s). The space created between layers also aids in increased noise absorption and reduction by dissipating the pulse of excess air following the projectile's exit through and out of the barrel immediately after the projectile or projectiles exit from the barrel.

The present design is significantly different than those designs existing in the prior art where prior art examples do not use inner chambers within outer chambers to redirect and/or shunt compressed gases ahead of a projectile as it travels the length of a barrel to at least partially depressurize the area behind a projectile and within the inner sleeve at an area of a barrel proximal to s user, wherein, when a projectile is fired, gasses may, in the present invention, travel through the one or more openings in the inner sleeve and into the space between the inner and outer barrel sleeves, as the projectile travels through and down the inner barrel, where the interior of the chamber is typically made to retain captured gasses until the projectile has left the barrel. In existing barrel structures and configurations, the propulsive gas following a projectile is released immediately after the projectile has left the muzzle of the barrel, creating sound waves conveying and telegraphing, to nearby observers, the projectile's exit. In opposite of presently available technology, the present design and structure utilizes a secondary internalized space between an inner layer, running coextensive with but surrounded by an outer chamber, and in concert with the primary outer chamber, as to create a bypass route where gasses behind a projectile may move to forward ports, ahead of a projectile and before a projectile's exit, wherein gasses are discharged ahead of the projectile and not as the projectile leaves the barrel. This is important in that the pneumatic pressures between the internal and external chamber are kept to a minimum, thus limiting elevated sound levels and allowing for a more controlled and a straighter flight path than those offered in the prior art.

SUMMARY OF THE INVENTION

The present invention is a Pneumatic Launcher Barrel Housing System and method of use primarily used as a high velocity, low energy air weapon projectile (e.g., paintball) gun (marker) barrels composed of one to a plurality of external cylindrical sleeve layers surrounding an internal sleeve layer or layers. Whereas conventional barrels only have one single cylinder layer, so as to surrender control of a projectile's path which are not able to contain, regulate, and redirect exhaust gasses escaping through the porting of concentric outer layer and inner layer(s) layers, allowing for the venting or shunting of propulsive gases prior to a projectile's and before a projectile leaves the said barrel. Ideally, if a barrel has an internal sleeve or sleeves surrounded by an external sleeve, together with porting of the internal sleeve, whereby dissipation of air is only transitory until the projectile has exited the barrel whereby the propulsive, highly pressurized gas nonetheless follows a high-to-low pressure gradient to exit the barrel. Conventionally, where an inner sleeve/outer sleeve combination and air porting is absent, the sudden exodus of air demonstrates (a) deleterious effects on flight path with nearly instantaneous (b) increased noise production.

The external sleeve layer itself is a structural housing component surrounding an internal layer or layers consisting of one or more sleeves arranged so that each internal sleeve (or sleeves) exhibits smaller diameters than the most immediate outer layer and all sleeves are coaxially arranged making up the bore of the barrel. Preferably, internal sleeves are secured via a series of supports within the interior of the external housing, between an inner and outer layer, in such a fashion to allow for the internal sleeve(s) to be optionally removable, replaceable and/or re-insertable by the user. What is more, any one, or a plurality of inner (internal) sleeves may have one to a number of ports, holes or other type of channel or communication allowing for compressed gas to pass from internal to the innermost sleeve or sleeves and into a space existing between any inner or outer sleeve. Said ports, holes, channels or similar apertures, collectively called communications, existing therethrough and across the thickness of an inner barrel, may be uniform, nonuniform, singular, a plurality, evenly or unevenly placed, in series or offset, in a repeating pattern or non-repeating pattern, of the same shape (i.e., circular, diamond shaped, square, rectangular, triangular, oval) or a combination of said shapes, whether repeating or nonrepeating. What is more, inner barrels existing in combination (e.g., an inner barrel within another, smaller diameter barrel, or plurality of barrels or barrels within barrels) may exhibit one to any number of ports, holes, channels or similar communications, singularly per each inner barrel, in plurality across one to several inner barrels, singularly or in plurality, uniformly or non-uniformly placed therethrough across the thickness of one to a plurality of inner barrels which may be placed at any point along the flight path of a projectile for venting, to an immediately contiguous out sleeve or a next internal sleeve, for venting or channeling of propulsive gases from behind a projectile to either a next outer space or for exodus through the barrel's muzzle. As conceived by inventors, one or each internal and/or external barrel may be removable and/or replaceable.

Further, it is within the contemplation of inventors that the outer barrel may, itself, contain one to a plurality of ports, holes, channels or similar communications (here with the internal area subsumed by the outer sleeve and ambient exterior), which may be positioned to be opened, partially-occludable, or fully-occludable, at the discretion of the manufacturer or user, as to provide an adjustable release of pressure via an adjustable mechanism as to provide variable levels of accuracy, to correct flight path or to adjust the audible footprint created by a released projectile potentially through an exterior manual manipulation wherein removal and replacement of an inner barrel or barrels may be obviated or further facilitated. This communication, from any space within the outer barrel to outside of the outer barrel may be thereby captured or released.

It is further within the contemplation of inventors that there may exist both inner sleeve (or sleeves) ports, holes, channels or similar "communications" in combination with outer barrel, exteriorly residing ports, holes, channels or similar communications which may be used to further refine and modify the control and release of compressed gases as to positively affect projectile control and/or sound creation.

Primarily, the internal sleeve's main purpose is to maintain a close pneumatic seal proximity conforming to the diameter of a paintball so that the paintball can be properly accelerated and propelled through the primary internal sleeve from the propulsive force created by the paintball gun's accelerating and expanding gasses travelling from the gas source to, through and out of the barrel's muzzle. The purpose of any length of an internal sleeve, after any acceleration area, or additional, smaller diameter, internal sleeves in conjunction with the primary internal sleeve, would be to dissipate "air" or other propulsive gas pressure from behind the paintball in a controlled manner via porting openings or increased (or decreased) through adjustments of diameters in the internal sleeve(s), in addition to any porting or channeling, as the paintball is guided and/or propelled down the remainder of the sleeve(s) toward the exit end (muzzle) of the barrel. Allowing excess air pressure to dissipate (i.e., release) from behind the paintball (to in front of the paintball) and prior to the paintball exiting the barrel prevents any excess air pressure from rapidly escaping around the paintball as it exits the end of the barrel.

This near-immediate discharge of a power source (e.g., gasses), in the prior art, creates a large pressure "buildup" characterized by a rapid escaping air from behind and around the projectile as the paintball leaves the barrel muzzle thus creating a potentially detrimental effect on flight path of the paintball leading to deviations in flight paths and resultant inaccuracy. Moreover, the large bolus of pressurized gas creates marked sound waves creating an auditory signal that the projectile has been launched and the pneumatic device has been "fired". By pre-venting this gas release, allowing for gases to be shunted and released ahead of the projectile provides (1) a more correct or truer flight path and (2) audible indications of projectile release are greatly lessened.

The internal sleeves can be optionally removed to facilitate cleaning, inspection, and changing of bore size, change of shape and number of ports, channels or communications between internal spaces and/or concentric barrels and manipulating gas dissipation options where removal may be utilized to repair or replace a barrel and/or different sized sleeves may be selected, themselves potentially having different hole sizings, hole spacing and/or hole distribution, which may be changeable and interchangeable as desired by a user in order to customize the influences said barrel has on a projectile flight path, speed, trajectory, sounds or a combination thereof.

Additionally, the type and construction of an internal barrel may be augmented or modified to facilitate accuracy, generate speed, lessen speed, decrease the auditory indications of an exiting projectile from a pneumatic device's barrel or a combination thereof, both external and internal, may be used to incrementally influence both flight path/trajectory) and sound created.

It is further in the contemplation of inventors that a balance may be achieved between influence on projectile path and noise reduction which may be modifiable taking into account the various perimeters of the pneumatic launcher barrel including, but not limited to: projectile construction, projectile diameter, barrel materials, number of internal (coaxial) chambers, barrel or barrels' length, barrel or barrels' diameter, number and shape of exit port holes, size of port holes, shape of port holes, placement of port holes or a combination thereof of the above.

The existing prior art fails to provide a dual lumen structure whereby a space (i.e., reservoir) is created between layers for the collection, movement, channeling and dissipation of pressurized gases which are vital to projectile propulsion but also may act upon the same projectile causing untoward deviations in flight path leading to a loss of accuracy. Too, the exodus of a large amount of compressed gas from behind a projectile, upon the projectile's leaving the muzzle of a barrel generates a commensurate generation of noise—which may be detrimental to a user by allowing other users, in a game of paintball, to know the origination of the projectile as well as the user's position.

The present invention seeks to cure the deficiencies in the art by the above provided means as to provide structures and functions to meet a long felt and unaddressed need in the art to provide enhanced accuracy and decreased sound in the launch of a pressurized gas projectile propulsion system

BRIEF DESCRIPTION OF THE DRAWINGS

Advantages and other aspects of the invention will be readily appreciated by those having skill in the art and may be better understood with further reference to the accompanying drawings wherein like reference numbers designate particular elements throughout the several figures of the drawings. The detailed description itself refers to the following drawings, in which like numerals refer to like objects, and in which the drawings, having been previously described in general terms, are now made explicit in the following drawings, which are not necessarily drawn to scale, and which may not encompass all features described herewith or all combinations envisioned by inventors wherein.

It should however be appreciated that the above figures and summary are not intended to limit the invention to any particular embodiment disclosed, but on the contrary, the invention disclosure is intended to cover all modifications, alternatives and equivalents falling within the spirit and scope of the invention as defined within the claim's broadest reasonable interpretation consistent with the specification.

DETAILED DESCRIPTION OF THE DRAWINGS

Some, but not all, embodiments of the present invention will be described more fully, hereinafter, with reference to the accompanying figures. To be sure, the present invention and method of use may be embodied in many varied forms and various ways and should not be construed as limited to only those iterations provided, which are provided simply as representative embodiments.

Equally, it should be observed that the present invention can be understood, in terms of both structure and function, from the present disclosure and the appended claims, taken in context with the associated drawings. And whereas the present invention and method of use are capable of undertaking several different embodiments, permutations, and varied and variable uses, which can be modified into several different iterations, each exhibiting accompanying interchangeable functionalities, without departing from the scope and spirit of the present application as shown and described.

The following 'Legend' is provided as to designate those numbers within the following numbered figures as provided below:

LEGEND

Figure 1:
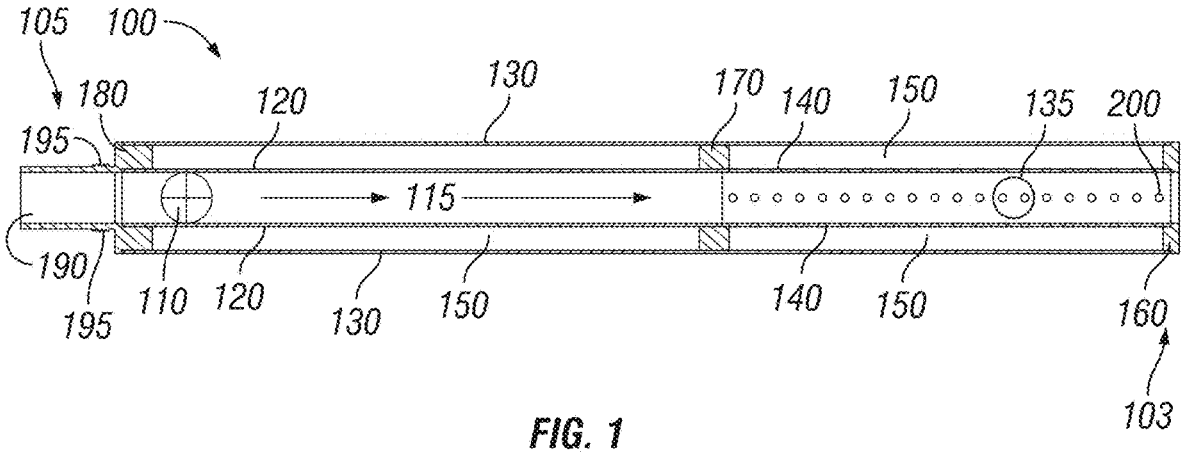
FIG. 1 depicts a cutaway view of the Pneumatic Launcher Barrel Housing System.
Figure 2:
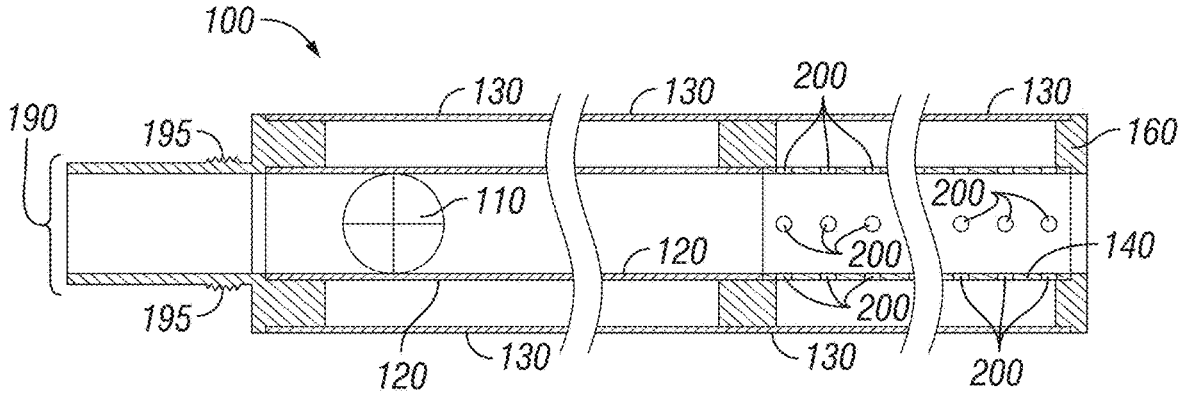
FIG. 2 illustrates an enlarged cutaway view of the Pneumatic Launcher Barrel Housing System and excess lengths condensed for easier viewing of details.
Figure 3:
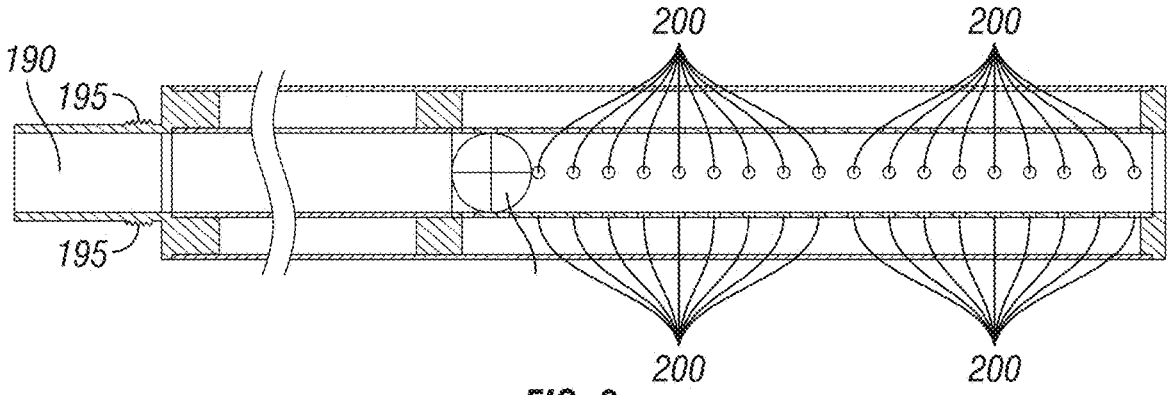
FIG. 3 illustrates a projectile within a first section of a Pneumatic Launcher Barrel Housing System past the primary internal layer and within the first section of the subsequent contiguous internal layer.

100 Pneumatic Launcher Barrel Housing
105 proximal first end
108 distal second end
110 projectile
115 projectile direction
120 primary internal layer
130 outer layer
140 contiguous internal layer
150 space
160 front support
170 middle support
180 rear support
190 extension
195 extension threaded portion
200 communications
210 communications behind said projectile 110
220 communications in front of said projectile 110
700 area of high pressure
710 area of low pressure
750 muzzle exit According to some embodiments, FIG. 1 and FIG. 2 depict a cutaway of a Pneumatic Launcher Barrel Housing 100 view showing a projectile 110, the structural outer layer 130 containing the primary internal layer 120 as well as a contiguous internal layer 140 to primary internal layer 120, said contiguous internal layer 140 exhibiting a space 150 (i.e., a chamber or chambers) between the external layer 130 and internal layers 120, 140. The internal layers 120 and 140 exist coaxially and within structural out layer 130, sharing the centerline of the external layer 130 which is secured via front support 160, middle support 170, and rear support 180 which restrict the internal layer(s) 120 and 140 from movement within outer layer 130 and hold said primary internal layer 120 and contiguous inner layer 140 securely until such time as removal and/or replacement is warranted and/or desired.

The rear support 180 may also be connectedly integrated into an extension 190, which itself may exhibit a threaded portion 195 about the outer surface of said extension 190, which may be used as a mounting method for affixing the entire assembly to a paintball gun and can be optionally removed to facilitate changing paintball gun mounting standards as well as removal and/or replacement of one or both of primary internal layer 120 and contiguous inner layer 140.

The front support 160 may also be optionally removable to facilitate removal (and/or replacement) of internal layers 120, 140 wherein one or both of said primary internal layer 120 and contiguous inner sleeve layer 140 may be removed and/or replaced. In this particularized embodiment, the substantial air gap (space 150) encompasses an area large enough to allow unrestricted pneumatic fluid (pneumatic gas) flow (from an areas of high pressure to an area of low pressure) from a point proximal to the user (proximal first end 105) to a point distal to the user (distal second end 108) through communications 210, which may be a port, hole or channel existing across the thickness of internal sleeve layer 140, from any point before the projectile 110 (between middle support 170 and projectile 110 as in FIGS. 4 and 5), through space 150 existing between contiguous inner layer 140 and outer layer 130, as projectile 110 moves in direction 115, from proximal first end 105 to distal second end 108, to any other communication 220 forward of said projectile 110 via communications 200 in the subsequent internal layer 140, allowing excess air pressure to be shunted though communications 200 through the air gap 150 and back through another ports, holes, channels or similar communications 220 to exit the barrel in front of the projectile 110, creating a controlled bypass of excess air pressure around the paintball prior to the paintball exiting the barrel.

Figure 4:
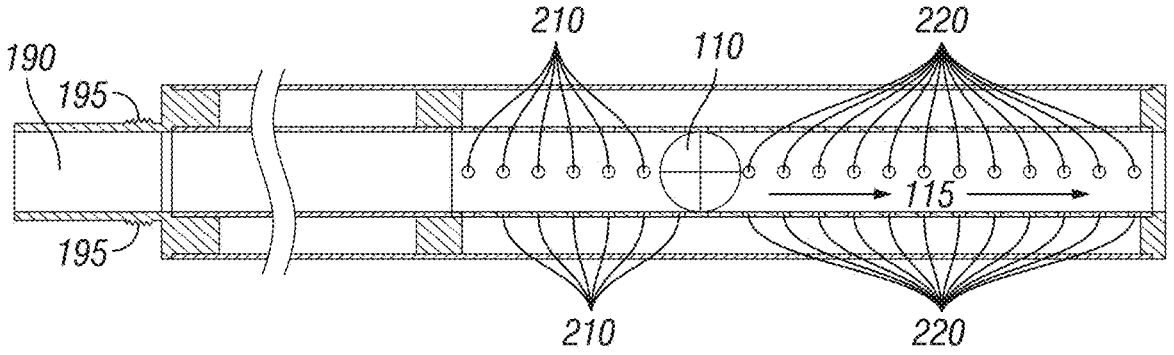
FIG. 4 shows a projectile within a first section of a Pneumatic Launcher Barrel Housing System past the primary internal layer and within a next section of the subsequent contiguous internal layer.
Figure 5:
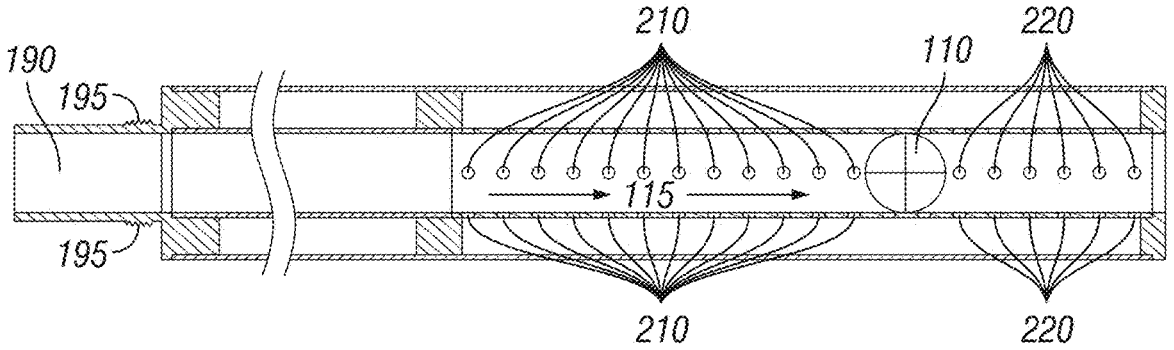
FIG. 5 shows a projectile within a first section of a Pneumatic Launcher Barrel Housing System past the primary internal layer and within a next section of the subsequent contiguous internal layer.
Figure 6:
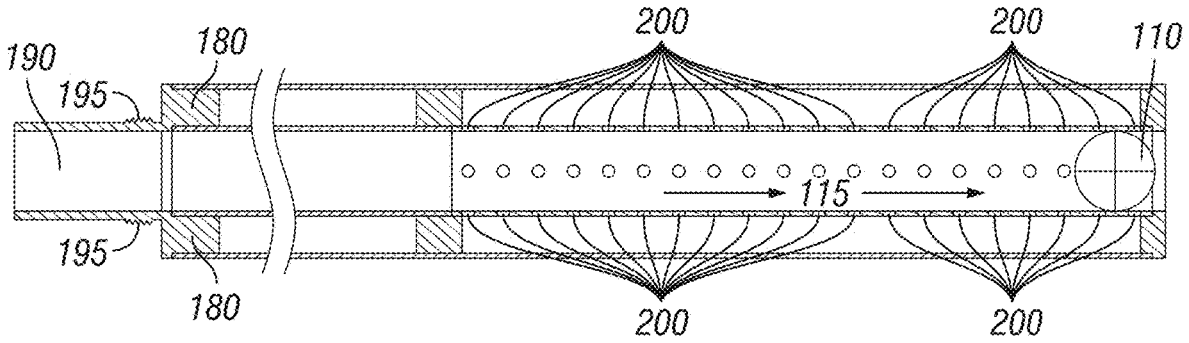
FIG. 6 depicts a cutaway view of the Pneumatic Launcher Barrel Housing System showing the roll of the porting as the projectile proceeds through the barrel.

FIGS. 3-6 show the flight trajectory of projectile 110 as it moves as projectile 110 enters contiguous inner sleeve layer 140, moves down pathway 115. From a point proximal to a user 105 to a point distal to a user 108 (as designated in FIG. 1) wherein communications 200 are further subdivided into communications 210 and communications 220, which have no effect on their structure, but are a representational depiction of the result of change in function of communications 200 into communications 210, 220, from compressed gas outlet to compressed gas inlet, relative the position of projectile 110. By way of example and demonstration, as projectile 110 accelerates along pathway 115, due to the positive affect of provided propulsive gases and moves from proximal point 105 to distal point 108, communications 200 (in FIG. 3), transition from communications 210, rearward of projectile 110, as projectile 110 moves along pathway 115, to communications 220 in front of projectile 110 (as shown in FIGS. 4 and 5). Finally, upon the exit of projectile 110, all communications again resume the same function and become communications 200 reflective of the same utility.

Figure 7:
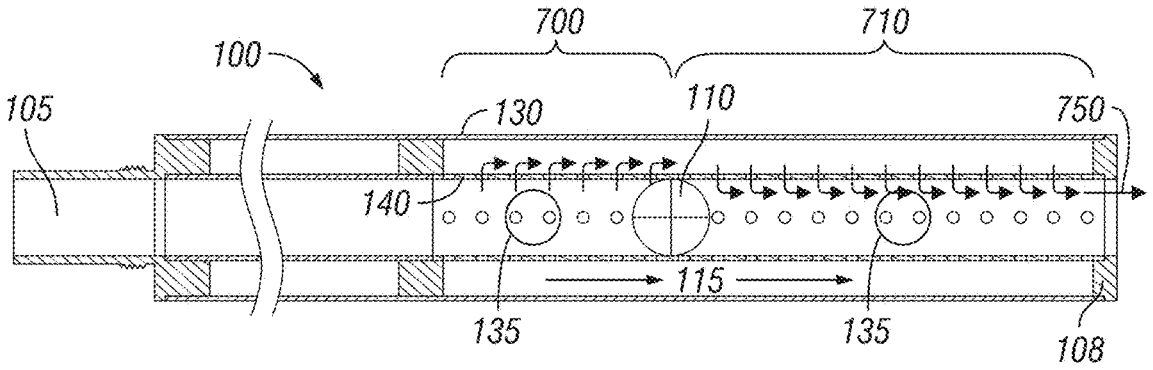
FIG. 7 illustrates the pathway of propulsive fluid movement within the present invention.
Figure 8:
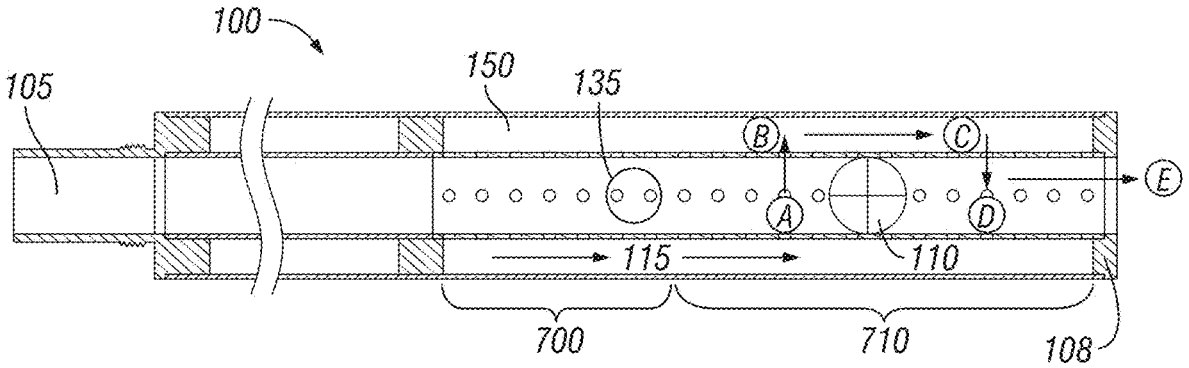
FIG. 8 is a representation of the pathway of propulsive fluid movement.

As illustrated in FIGS. 7 and 8, communications 200 are generally designated (represented as communications 210, in area 700—an area of cavity 135 of the contiguous inner layer 140 where projectile 110 has previously traversed) wherein communications 210 exist through the thickness of inner sleeve 140, creating a channel, aperture or port between inner sleeve 140 and outer sleeve 130 and allowing pressurized gas movement from said area 700 into space 150 (e.g., a parallel-running reservoir) allowing for gas movement from an area of high pressure to low pressure and thereafter reentering cavity 135 of inner sleeve 140 through communications 220 in area 710 and out of the exit 750 (muzzle) which are arranged in such a way that as a projectile 110 progresses down the barrel (from proximal first end 105 to distal second end 108) and across the communications 200 those communications "change" from outlets to inlets for the movement of pressurized gas as projectile 110 traverses cavity 135. Equally, instead of the communications 200 only being static in their roll of absorbing air pressure within the space 150 between inner sleeve 140 and outer sleeve 130 (and from "behind" the projectile 110 in area 700), themselves allowing for distribution of air pressure into an auxiliary cavity (space 150) (and thereafter the area 710, distally) until the projectile has ultimately exited the barrel. Therefore, the function of communications 200 dynamically change, binomially, to allow air pressure to exit the internal cavity 135 at one time (t), to then enter the space 150 between an outer sleeve 130 and inner sleeve 140 thereafter allowing air pressure to exit space 150, in front of and ahead of a projectile 110, and to exit through the front of the barrel 750 before projectile 110 has exited the device 100. And finally, once projectile 110 has exited the pneumatic barrel housing system 100, all pressure normalizes to equal that of the ambient air surroundings.

Representationally, as in FIG. 7, this pathway is shown with a single communications 200, "outlet" communication 210, allowing air pressure into space 150 and then into space or reservoir "exhausting" ports, holes, apertures or channels or similar communications, here "inlet" communications 220 are shown as allowing pressurized gas to re-enter the barrel shared by both propulsive fluid (compressed gas) and projectile 110 but in front of projectile 110 and thus exhausted out and in front and ahead of projectile 110 and the barrel (through exit 750) prior to projectile 110 launch.

As shown in FIG. 8, propulsive fluid (compressed gas) follows the path from area of highest gas pressure before projectile 110 (area 700 at Point A within the inner sleeve 140 internal cavity 135) through communication 210 to an area of lower gas pressure (into space 150 at point B) acting as a transitory reservoir of gas pressure (Point C) before reentering the inner sleeve 140 internal cavity 135 through communication 220 (area 710 at Point D) and exiting the inner sleeve internal cavity (Point E) via barrel exit 750 and ahead of projectile 110. This diagram is, however, representative of a single pathway where it is to be understood that the process may be facilitated through any number of communications 200, before and after said projectile 110, which is a dynamic process of pressurized propulsive gas channeling and dissipation from areas of high pressurization to low pressurization as the projectile 110 moves from the proximal 105 to distal 108 end of the present device 100 which is the Pneumatic Launcher Barrel Housing System. In fact, inventors contemplate that a multiplicity of communications 200 (existing as communications 210 and communications 220, from areas 700 to 710, respectively) carry on the presently described process, method and pathway(s) fluidly and in concert as the projectile moves down the inner sleeve 140 toward and through the barrel's exit. This is advantageous for not only projectile 110 accuracy control, after leaving the barrel, but also for reducing noise indicative of gas release.

A means of example, and as one preferred embodiment, as the spherical dye-filled gelatin capsule (projectile 110) from a paintball gun, of which the present invention would be a vital component, is actuated via compressed gas (e.g., ambient air, nitrogen or carbon dioxide) to garner sufficient speed to traverse the length of the barrel (inner sleeves 120, 140), the projectile 110 travels through the primary internal layer 120 where it is accelerated from the expanding gasses of compressed air. The primary internal layer 120 itself is selected to be close in internal bore diameter to that of the projectile 110 diameter, or vice versa, such that the projectile 110 is efficiently accelerated through the primary internal layer 120 with minimal air pressure escaping past the capsule (as would be observed in a typical barrel). After accelerating through the primary internal layer 120, the projectile 110 continues traveling through the contiguous internal layer 140 where any remaining expanding gasses from the compressed air can dissipate from behind the capsule to in front of the capsules, through various communications 200 and out of the barrel muzzle, here starting at the point of middle support 170, such that by the time the projectile 110 exits the end of the barrel, sufficient compressed gas has been utilized to accelerate the capsule/projectile but there is reduced or negligible remaining expanding gasses to escape from around the capsule after leaving the end of the barrel. Thereby, gas absorption into a designated space 150, between an inner layer 140 and outer layer 130, and from area 700 to area 710 and gas redirection, shunting and channeling acts to allow the compressed gas to beneficially rapidly accelerate a projectile 110 but not unduly influence that same projectile's 110 course as an unaided bolus of air would exit the barrel 750 in an instantaneous release unavoidably altering the flight path of projectile 110 and also creating an audible noise as a result of pressure releasing from a high to low pressure area.

OBJECTS OF THE INVENTION

One object of the present invention is to provide a Pneumatic Launcher Barrel Housing System that allows for the removal of internal layer(s) from external layer(s) for customization (changing of barrel bore, barrel length, barrel materials as well as various venting port configurations and gas dissipating options) and for the purposes of cleaning, inspection, repair and replacement.

Another object of the present invention is to provide a Pneumatic Launcher Barrel Housing System that secures the internal layer to the external layer in such a way that a "ventable" air gap space (i.e., chamber or reservoir) is maintained between one or more of the external and internal layers whereby there is a sealed chamber or reservoir between each barrel which only allows for gas sequestration and release ahead of a projectile via vented ports. Such an air gap layer aids in noise isolation and damping of air pressure being dissipated, from behind a projectile to in front of projectile, prior to release from the barrel.

It is yet another object of the present invention to aid in the accuracy of a projectile leaving the barrel of a pressurized air-utilizing projectile launcher to provide a conduit or conduits for sequestration, channeling and redirection of pressurized gas from behind a projectile to in front of a projectile as to provide greater control and guidance of said projectile which may be modifiable and alterable based on the configuration of sleeves, the materials of both sleeves and projectile and the number, size, placement and arrangement of communications (i.e. apertures) within said inner sleeve or sleeves.

While the present invention has been described in terms of particular embodiments and applications, in both summarized and detailed forms, the present description is not intended, in any way, to limit the present invention's scope to any such embodiments and applications. On the contrary, those having ordinary skill in the art should, in light of the present disclosure, appreciate that many changes can be made in the specific embodiments described and still obtain a like or similar result without departing from the spirit and scope of the present disclosure. Numerous alternative forms, equivalents, and modifications will become apparent to those skilled in the art once the above disclosure is fully appreciated. And it will be understood that many substitutions, changes and variations in the described embodiments, applications and details of the method and system illustrated herein and of their operation can be made by those skilled in based on the disclosure and description of the present invention and its uses.

We claim:

1. A Pneumatic Barrel Housing System for launching a projectile exhibiting coaxially configured sleeves comprising the elements of:

a propelled projectile;

a means of pneumatic propulsion;

said means of pneumatic propulsion being a compressed gas;

a cylindrical external, outer tubular sleeve and a cylindrical internal, inner sleeve, sharing a center line, exhibiting a space therebetween;

said external, outer tubular sleeve and a cylindrical internal, inner sleeve having a first end proximal to the user and a second, terminal end distal to the user;

said internal, inner sleeve in sealed communication with said external, outer tubular sleeve;

said internal, inner sleeve running contiguously and coaxially along and within the length of said external, outer sleeve;

said internal, inner sleeve having a diameter less than said external, outer tubular sleeve;

said inner sleeve exhibiting a projectile pathway from said first end to said second end;

said internal sleeve exhibiting at least one communications, spanning the thickness of said internal sleeve, as to provide a communication between said internal sleeve's internal space and the space existing between said external, outer tubular sleeve and said cylindrical internal, inner sleeve;

said at least one communication exhibited along the length of said internal sleeve so as to allow highly pressurized gas to be directed from behind said propelled projectile and from an interior space within said internal sleeve, into said space existing between said internal and external sleeves, into said inner sleeve's internal space ahead of said projectile and exiting said inner sleeve at said second end and ahead of said projectile.

2. The Pneumatic Barrel Housing System of claim 1 wherein said inner sleeve, said outer sleeve, or a combination thereof is removeable and replaceable.

3. The Pneumatic Barrel Housing System of claim 1 wherein said inner sleeve comprises at least one cylindrical, inner sleeves wherein each inner sleeve has a diameter less than the contiguous outmost inner sleeve and a space exists between cylindrical, inner sleeves.

4. The Pneumatic Barrel Housing System of claim 3 wherein said inner sleeve comprises at least one cylindrical, inner sleeves comprising:

a space between said innermost sleeve and the next outer sleeve; and at least one communications between said space between said each inner sleeve and said next outermost sleeve.

5. The Pneumatic Barrel Housing System of claim 4 wherein said at least one communication between said space between inner sleeve, or inner sleeves, act to channel said compressed gas from an area behind said propelled projectile, and within a projectile's sleeve, to an area outside of said projectile's sleeve.

6. The Pneumatic Barrel Housing System of claim 1 wherein said compressed gas is high-pressure air, nitrogen or carbon dioxide.

7. The Pneumatic Barrel Housing System of claim 6 wherein said compressed gas is facilitatedly released from said first end area behind said projectile and within said inner chamber providing said projectile pathway, into an area in said space existing between at least one inner sleeves and said outer sleeve, into an area in front of said projectile and within said inner chamber providing said projectile pathway, and exiting said internal sleeve from a second end area.

8. The Pneumatic Barrel Housing System of claim 7 wherein said outer sleeve has an additional communication through said outer sleeves' thickness for gas expulsion exterior to said outer sleeve wherein said gas is captured or expelled.

9. The Pneumatic Barrel Housing System of claim 8 wherein said inner sleeve or sleeves is/are removable and replaceable, said outer sleeve is removeable and replaceable, or a combination thereof.

10. A Pneumatic Barrel Housing device for shunting compressed gasses and guiding a projectile from a pneumatic launcher barrel as to aid in projectile accuracy by facilitating said projectile's straight flight path and minimizing sound upon expulsion comprising:

a structural barrel housing;

said structural barrel housing exhibiting a cylindrical external, outer tubular sleeve and a cylindrical internal, inner sleeve, running coaxially, exhibiting a space therebetween;

said internal sleeve of a smaller diameter and exhibited within said cylindrical external, outer tubular sleeve layer;

said internal layer in sealed communication with said external sleeve layer;

said internal layer exhibiting communications existing through the thickness of said internal layer allowing pressurized gas to move from within said internal layer, and from behind an accelerated projectile, to a space exiting between the internal and external layers and into an area within said internal layer, and in front of said accelerated projectile;

said pressurized gas allowed to move into said space existing between internal and external sleeves, in front of said projectile and out of said barrel prior to projectile or exterior to said outermost sleeve allowing gas channeling from behind said projectile, prior to projectile exit, moving pressurized gas from an area of high pressure to low pressure, thereby facilitating reduced pressure behind said projectile, said straight flight path and said reduced noise production.

11. The Pneumatic Barrel Housing device of claim 10 wherein said internal sleeves consists of one to a plurality of internal sleeves.

12. The Pneumatic Barrel Housing device of claim 11 wherein said external and internal sleeve or sleeves are of different sizes, diameters, materials and thicknesses as to control and modify projectile speed and accuracy.

13. The Pneumatic Barrel Housing device of claim 10 wherein said communications are gas channeling ports or apertures, existing across the thickness of an internal sleeve, an external sleeve, or a combination thereof, which are uniform, nonuniform, singular, in one to a plurality, evenly or unevenly placed, in series or offset, in a repeating pattern or non-repeating pattern, of the same shape (i.e., circular, diamond shaped, square, rectangular, triangular, oval) or a combination of said shapes, whether repeating or nonrepeating.

14. The Pneumatic Barrel Housing device of claim 13 wherein said outer sleeve is removeable and replaceable, said inner sleeve is removeable or replaceable, or a combination thereof.

15. A method of utilizing an inner barrel sleeve and outer barrel sleeve to provide accuracy and decreased noise of a propelled projectile comprising the steps of:

providing a propulsive gas;

placing within an outer barrel sleeve an inner barrel sleeve;

said inner sleeve and outer sleeve having a first end proximal to the user and a second end distal to said user;

said inner sleeve having an exit;

said inner sleeve running coaxially within said outer sleeve;

said inner sleeve having an open exit for release of a projectile and gas;

said inner sleeve in sealed communication with said outer sleeve;

said inner sleeve and outer sleeve having a space therebetween;

placing within said inner sleeve said projectile;

said projectile propelled by said propulsive gas;

placing through the thickness of said inner sleeve one to a plurality of communications;

said communications allowing fluid movement of said propulsive gas from said first end, along a gradient from high pressure to low pressure and from behind said projectile in an inner sleeve cavity and projectile pathway, through one to a plurality of said communications, into said space, and ahead of said projectile thereby returning to said inner sleeve cavity and projectile pathway, ahead of said projectile, for said gas' expulsion through said barrel muzzle and ahead of said projection prior to projectile exit;

placing said projectile within said inner barrel at said first end;

providing said propulsive gas;

propelling said projectile from said first end to said second end;

porting propulsive gas from behind said projectile, at said first end, through said communications and into said space between said inner sleeve to said out sleeve;

directing said propulsive gas in front of said projectile; and allowing said directed propulsive gas to exit said second end and ahead of said projectile prior to projectile existing said second end.

16. The method of claim 15 wherein said inner sleeve further comprises placing one to a plurality of communications through the thickness of said inner sleeve.

17. The method of claim 15 wherein said inner sleeve further comprises placing, removing or replacing, or a combination thereof, said inner sleeve, said outer sleeve or a combination thereof.

18. The method of claim 15 wherein said inner sleeve constitutes a first inner sleeve which further comprises placing within said first inner sleeve an additional inner sleeve or plurality of inner sleeves;

said each additional inner sleeve or plurality of inner sleeves creating a space between said additional inner sleeve or plurality of inner sleeves and a next outer sleeve; and said additional inner sleeve or plurality of inner sleeves exhibiting one or more communications for venting of propulsive gas.

19. The method of claim 15 wherein said outer sleeve further comprises inserting therethrough a communication for propulsive gas into said first end, into second end, or any space therebetween and exit, exterior to said outer sleeve, or a combination thereof.

20. The method of claim 15 wherein said communications are channeling ports or apertures, existing across the thickness of an internal sleeve, an external sleeve, or a combination thereof, which is uniform, nonuniform, singular, in a one to a plurality, evenly or unevenly placed, in series or offset, in a repeating pattern or non-repeating pattern, of the same shape (i.e., circular, diamond shaped, square, rectangular, triangular, oval) or a combination of said shapes, whether repeating or nonrepeating.

* * * * *